US008836605B2

(12) United States Patent
Lin et al.

(10) Patent No.: US 8,836,605 B2
(45) Date of Patent: Sep. 16, 2014

(54) EMBEDDED ANTENNA

(75) Inventors: Hui Lin, Taoyuan (TW); Chao-Hung Kuo, Keelung (TW)

(73) Assignee: Quanta Computer Inc., Tao Yuan Shien (TW)

( * ) Notice: Subject to any disclaimer, the term of this patent is extended or adjusted under 35 U.S.C. 154(b) by 232 days.

(21) Appl. No.: 13/443,999

(22) Filed: Apr. 11, 2012

(65) Prior Publication Data

US 2013/0181879 A1 Jul. 18, 2013

(30) Foreign Application Priority Data

Jan. 16, 2012 (TW) ..... 101101643 A

(51) Int. Cl.
*H01Q 1/40* (2006.01)
*H01Q 1/46* (2006.01)
*H01Q 1/48* (2006.01)

(52) U.S. Cl.
CPC ... *H01Q 1/48* (2013.01); *H01Q 1/46* (2013.01)
USPC ..... 343/873; 343/702; 343/834

(58) Field of Classification Search
CPC ..... H01Q 1/48; H01Q 1/46; H01Q 1/2258; H01Q 9/06; H01Q 1/40
USPC ..... 343/873, 843, 790, 791, 792, 702
See application file for complete search history.

(56) References Cited

U.S. PATENT DOCUMENTS

| | | | | |
|---|---|---|---|---|
| 6,133,884 | A * | 10/2000 | Talvitie et al. | 343/702 |
| 7,846,108 | B2 * | 12/2010 | Turovskiy et al. | 600/564 |
| 2007/0013607 | A1 * | 1/2007 | Town | 343/906 |
| 2007/0203480 | A1 * | 8/2007 | Mody et al. | 606/33 |
| 2010/0137857 | A1 * | 6/2010 | Shroff et al. | 606/33 |
| 2010/0231457 | A1 * | 9/2010 | Chen et al. | 343/702 |
| 2011/0004205 | A1 * | 1/2011 | Chu et al. | 606/33 |

* cited by examiner

*Primary Examiner* — Hoanganh Le
(74) *Attorney, Agent, or Firm* — Rabin & Berdo P.C.

(57) ABSTRACT

An embedded antenna is disclosed. The embedded antenna comprises a coaxial cable and a grounding connecting part. The coaxial cable comprises a center conductor, an insulating layer and an outer sheath. The center conductor comprises a signal transmission part and a radiating part. The radiating part electrically connects the signal transmission part and provides a resonance frequency. The insulating layer covers the signal transmission part and the radiating part. The outer sheath covers the signal transmission part but not the radiating part. The grounding connecting part electrically connects the system grounding part and the outer sheath.

14 Claims, 18 Drawing Sheets

EMBEDDED ANTENNA

This application claims the benefit of Taiwan application Serial No. 101101643, filed Jan. 16, 2012, the subject matter of which is incorporated herein by reference.

BACKGROUND OF THE INVENTION

1. Field of the Invention

The invention relates in general to an antenna, and more particularly to an embedded antenna.

2. Description of the Related Art

Referring to FIG. 1, a schematic diagram of an AIO using a conventional inverted-F antenna is shown. The AIO 1 uses a planar inverted-F antenna (PIFA) 11 for transmitting/receiving radio signals. The design of the inverted-F antenna 11 must be able to be adapted to surrounding environments. Despite the radio frequency (RF) specifications being the same for different antennas, respective antenna design is still required for respective antenna to meet the RF specifications of antenna radiating elements when operating under different surrounding environments. Therefore, in order to achieve the desired characteristics and performance, current technologies in antenna design must take the parameters related to the disposition position of antenna into consideration.

Regardless a computer being a notebook computer, a tablet PC or an all in one (AIO), the antenna of the computer is mostly disposed around the peripheral of the screen. Therefore, the design of antenna radiating elements will be based on the available 3D space around the peripheral of the screen. In terms of current design technologies for antennas, the lower the operating frequency, the larger the 3D space will be needed. Conversely, for an antenna with higher resonance frequency, the antenna radiating elements may be installed within a smaller 3D space. Therefore, the design of embedded antenna varies with the structure of the product, and a uniform design cannot satisfy respective radio frequency specifications for various structures. For antennas operating under similar surrounding environments and conditions, the antenna radiating elements (including the anode, the cathode, and the grounding part) need to be adjusted so as to be conformed to the RF specifications. Therefore, the design of antenna must be based on the surrounding environments and the disposition position of the antenna as well as the antenna radiating elements used in the antenna.

SUMMARY OF THE INVENTION

The invention is directed to an embedded antenna.

According to one embodiment of the present invention, an embedded antenna is disclosed. The embedded antenna comprises a coaxial cable and a grounding connecting part. The coaxial cable comprises a center conductor, an insulating layer and an outer sheath. The center conductor comprises a signal transmission part and a radiating part. The radiating part electrically connects the signal transmission part and provides a resonance frequency. The insulating layer covers the signal transmission part and the radiating part. The outer sheath covers the signal transmission part but not the radiating part. The grounding connecting part electrically connects the system grounding part and the outer sheath.

The above and other aspects of the invention will become better understood with regard to the following detailed description of the preferred but non-limiting embodiment(s). The following description is made with reference to the accompanying drawings.

DETAILED DESCRIPTION OF THE INVENTION

First Embodiment

Figure 2:
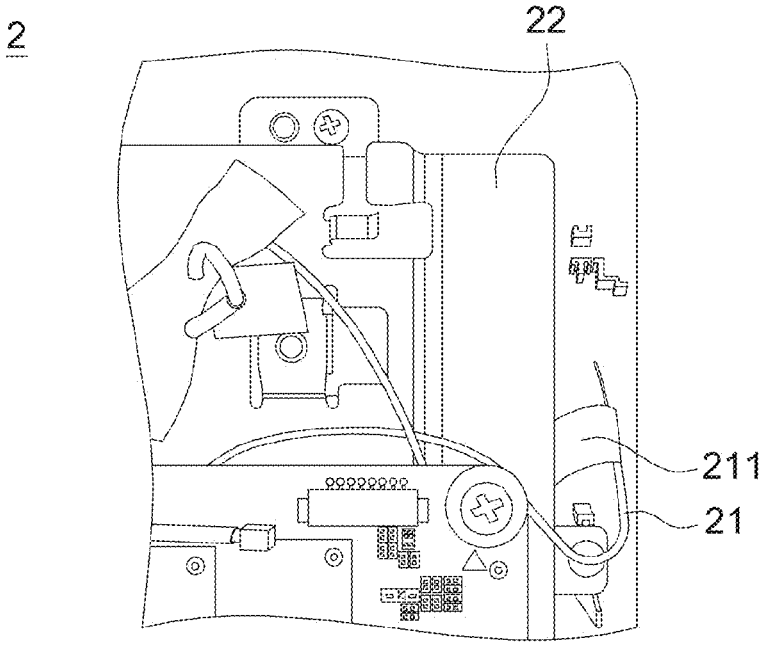
FIG. 2 shows a partial diagram of an electronic device with an embedded antenna.
Figure 3:
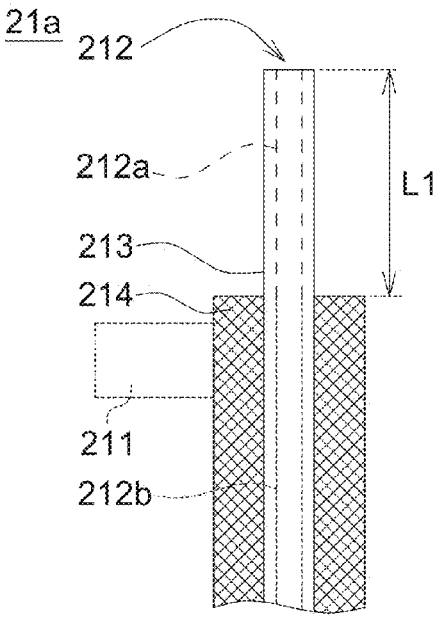
FIG. 3 shows a partial diagram of an embedded antenna according to a first embodiment.

Referring to FIG. 2 and FIG. 3. FIG. 2 shows a partial diagram of an electronic device with an embedded antenna. FIG. 3 shows a partial diagram of an embedded antenna according to a first embodiment. The electronic device 2 is realized by such as a tablet PC, a notebook computer or an all in one (AIO). The electronic device 2 at least comprises an embedded antenna 21 and a system grounding end 22. The system grounding end 22 is such as a metal mechanism of the electronic device 2.

In the present embodiment, the embedded antenna 21 is exemplified by an embedded antenna 21*a*. The embedded antenna 21*a* comprises a coaxial cable and a grounding connecting part 211. The coaxial cable comprises a center conductor 212, an insulating layer 213 and an outer sheath 214. The center conductor 212 comprises a radiating part 212*a* and a signal transmission part 212*b*. The radiating part 212*a* electrically connects the signal transmission part 212*b* and provides a resonance frequency. The radiating part 212*a* may be regarded as an outward extension of the outer sheath 214. When the embedded antenna 21*a* is used in wireless local area network (WLAN), the resonance frequency of the radiating part 212*a* ranges between 2.4 GH~2.5 GHz. The length L1 of the radiating part 212*a* corresponds to a quarter of the wavelength of the resonance frequency. When the resonance frequency ranges between 2.4 GH~2.5 GHz, the length L1 of the radiating part 212*a* is about 3 cm~3.125 cm. The length L1 of the radiating part 212*a* may be fine-tuned by adjusting the dielectric material of the insulating layer 213 or the wire diameter of the center conductor 212.

The insulating layer 213 covers the signal transmission part 212*b* and the radiating part 212*a*. The outer sheath 214 covers the signal transmission part 212*b* but not the radiating part 212*a*. The grounding connecting part 211 electrically connects the system grounding part 22 and the outer sheath 214. The grounding connecting part 211 is such as a copper foil tape. The grounding connecting part 211, being formed by a copper foil tape, not only electrically connects the system grounding part 22 and the outer sheath 214, but also fixes the embedded antenna 21*a* at the same time. In addition, the bandwidth of the embedded antenna 21*a* may further be increased through suitable adjustment in the width of the system grounding part 22.

In comparison to the planar inverted-F antenna (PIFA), the embedded antenna 21*a*, being formed by the coaxial cable mainly, incurs lower manufacturing cost. In addition, the embedded antenna 21*a* has lower space dependency, and only needs one groove for fixing the coaxial cable. The embedded antenna 21*a* may be disposed at any position around the rim of the electronic device 2. In comparison to the PIFA, the embedded antenna 21*a* does not need any positioning hole on the mechanism, so the mechanism design of the electronic device 2 may further be simplified and standardized. Also, since the outer sheath 214 is electrically connected to the grounding connecting part 211 via the system grounding part 22, the efficiency of the embedded may further be increased and antenna response may be self-adjusted in response to surrounding environments.

Second Embodiment

Figure 4:
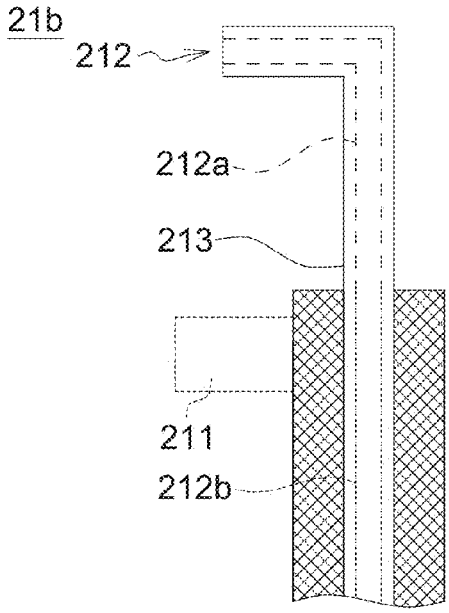
FIG. 4 shows a partial diagram of an embedded antenna according to a second embodiment.

Referring to FIG. 2 and FIG. 4. FIG. 4 shows a partial diagram of an embedded antenna according to a second embodiment. In the second embodiment, the embedded antenna 21 is exemplified by an embedded antenna 21*b*. The embedded antenna 21*b* is different the embedded antenna 21*a* mainly in that the radiating part 212*a* of the embedded antenna 21*b* may be designed as L-shape in response to the needs of surrounding environments. Thus, the embedded antenna 21*b* may be disposed at a corner of the electronic device 2, and the complexity in mechanism design may thus be reduced.

Third Embodiment

Figure 5:
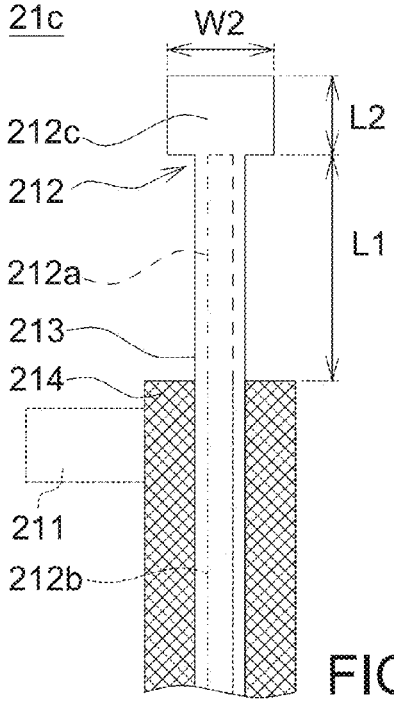
FIG. 5 shows a partial diagram of an embedded antenna according to a third embodiment.

Referring to FIG. 2 and FIG. 5. FIG. 5 shows a partial diagram of an embedded antenna according to a third embodiment. In the third embodiment, the embedded antenna 21 is exemplified by an embedded antenna 21*c*. The embedded antenna 21*c* is different the embedded antenna 21*a* mainly in that the center conductor 212 of the embedded antenna 21*c* further comprises a radiating part 212*c*. The radiating part 212*c* is electrically connected to the radiating part 212*a* to form a dual-frequency antenna used in a WLAN. The radiating part 212*a* provides a resonance frequency, and the other resonance frequency is formed by a combination of the resonance frequencies provided by the radiating parts 212*a* and 212*c*. The resonance frequency provided by the radiating part 212*a* is different from that provided by the radiating part 212*c*. For example, the resonance frequency provided by the radiating part 212*a* ranges between 5.15 GHz~5.85 GHz, and the other resonance frequency formed by a combination of the resonance frequencies provided by the radiating parts 212*a* and 212*c* ranges between 2.4 GHz~2.5 GHz.

The radiating part 212*c* may be extended as a geometric plane, and the shape of the geometric plane may be adjusted according to actual needs. For convenience of elaboration, the radiating part 212*c* of FIG. 5 is exemplified by a rectangular plane. The sum of the length L1 of the radiating part 212*a* and the length of L2 of the radiating part 212*c* is equal to the total length of the radiating parts 212*a* and 212*c*. The total length of the radiating parts 212*a* and 212*c* corresponds to a quarter of the wavelength of the resonance frequency 2.4 GHz~2.5 GHz. The length L1 of the radiating part 212*a* corresponds to a quarter of the wavelength of the resonance frequency 5.15 GHz~5.85 GHz. In the third embodiment, the total length of the radiating parts 212*a* and 212*c* is about 3 cm~3.125 cm. The length L1 of the radiating part 212*a* is about 1.46 cm~1.28 cm. The length L2 of the radiating part 212*c* is about 2 cm. In the third embodiment, the width W2 of the radiating part 212*c* is about 1 cm, and the width W2 of the radiating part 212*c* may be suitably adjusted to increase the bandwidth of the embedded antenna 21*c*.

Fourth Embodiment

Figure 6:
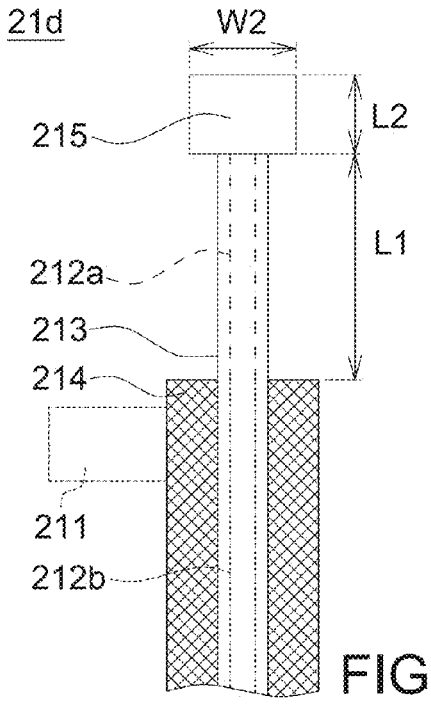
FIG. 6 shows a partial diagram of an embedded antenna according to a fourth embodiment.

Referring to FIG. 2 and FIG. 6. FIG. 6 shows a partial diagram of an embedded antenna according to a fourth embodiment. In the fourth embodiment, the embedded antenna 21 is exemplified by an embedded antenna 21*d*. The embedded antenna 21*d* is different the embedded antenna 21*c* mainly in that the radiating part 215 of the embedded antenna 21*d* is formed by a copper foil tape. The radiating part 215 is electrically connected to the radiating part 212*a* to form a dual-frequency antenna used in a WLAN. The radiating part 212*a* provides a resonance frequency, and the other resonance frequency is formed by a combination of the resonance frequencies provided by the radiating parts 212*a* and 215. The resonance frequency provided by the radiating part 212*a* is different from that provided by the radiating part 215. For example, the resonance frequency provided by the radiating part 212*a* ranges between 5.15 GHz~5.85 GHz, and the other resonance frequency formed by a combination of the resonance frequencies provided by the radiating parts 212*a* and 215 ranges between 2.4 GHz~2.5 GHz.

The shape of the radiating part 215 being a geometric plane may be adjusted according to actual needs. For convenience of elaboration, the radiating part 215 of FIG. 5 is exemplified by a rectangular plane. The sum of the length L1 of the radiating part 212*a* and the length L2 of the radiating part 215 is equal to the total length of the radiating parts 212*a* and 215. The total length of the radiating parts 212*a* and 215 corresponds to a quarter of the wavelength of the resonance frequency 2.4 GHz~2.5 GHz. The length L1 of the radiating part 212*a* corresponds to a quarter of the wavelength of the resonance frequency 5.15 GHz~5.85 GHz. In the third embodiment, the total length of the radiating parts 212*a* and 215 is about 3 cm~3.125 cm. The length L1 of the radiating part 212*a* is about 1.46 cm~1.28 cm. The length L2 of the radiating part 215 is about 2 cm. In the third embodiment, the width W2 of the radiating part 215 is about 1 cm, and the width W2 of the radiating part 215 may be suitably adjusted to increase the bandwidth of the embedded antenna 21*d*.

Fifth Embodiment

Figure 7:
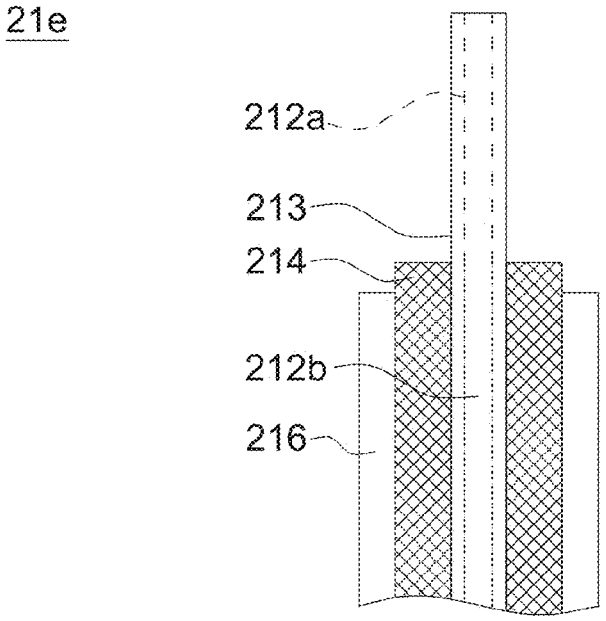
FIG. 7 shows a partial diagram of an embedded antenna according to a fifth embodiment.

Referring to FIG. 2 and FIG. 7. FIG. 7 shows a partial diagram of an embedded antenna according to a fifth embodiment. In the fifth embodiment, the embedded antenna 21 is exemplified by an embedded antenna 21*e*. The embedded antenna 21*e* is different the embedded antenna 21*a* mainly in that the embedded antenna 21*e* further comprises a metal sleeve 216. The metal sleeve 216, realized by such as an aluminum tube or copper tube, covers at least a part of the insulating layer 214. The embedded antenna 21*e* may increase the bandwidth with the use of the metal sleeve 216.

Sixth Embodiment

Figure 8:
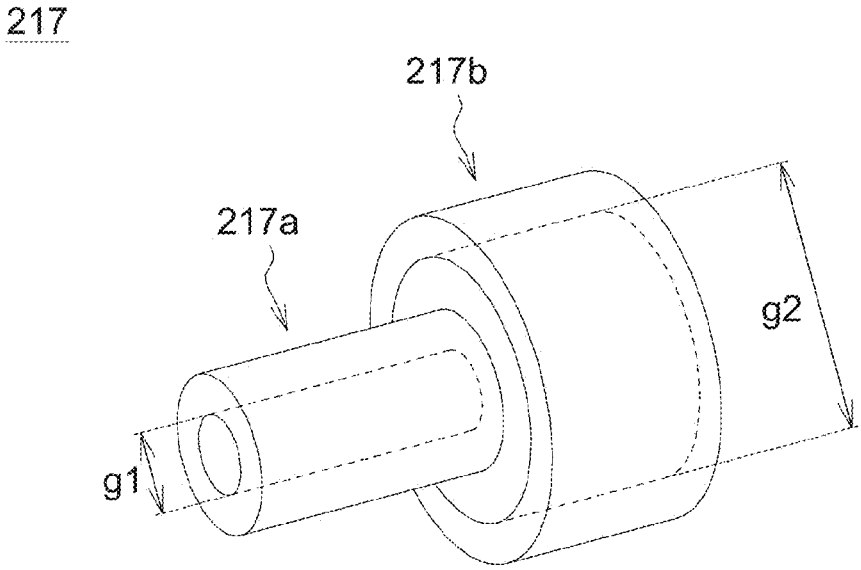
FIG. 8 shows a partial diagram of an embedded antenna according to a sixth embodiment.
Figure 9:
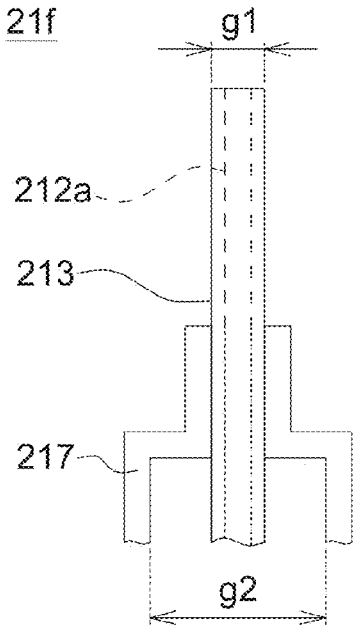
FIG. 9 shows a partial diagram of an embedded antenna according to a sixth embodiment.

Referring to FIG. 2, FIGS. 8 and 9. FIG. 8 shows a partial diagram of an embedded antenna according to a sixth embodiment. FIG. 9 shows a partial diagram of an embedded antenna according to a sixth embodiment. In the sixth embodiment, the embedded antenna 21 is exemplified by an embedded antenna 21*f*. The embedded antenna 21*f* is different the embedded antenna 21*a* mainly in that the embedded antenna 21*f* further comprises a metal sleeve 217. The metal sleeve 217 comprises a sleeve part 217*a* and a sleeve part 217*b* connected to the sleeve part 217*a*. The sleeve part 217*a* has a diameter g1, and the sleeve part 217*b* has a diameter g2 larger than the diameter g1. In the sixth embodiment, the sleeve part 217*a* is adjacent to the radiating part 212*a*, and the sleeve part 217*b* is extended outwards from the sleeve part 217*a* along a direction opposite to the extending direction of the radiating part 212*a*. The embedded antenna 21*f* may change the magnitude of bandwidth through the adjustment in the magnitude of the diameter g2.

Seventh Embodiment

Figure 10:
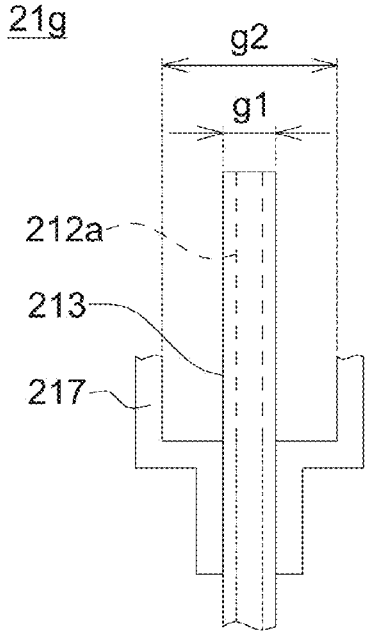
FIG. 10 shows a partial diagram of an embedded antenna according to a seventh embodiment.

Referring to FIG. 2, FIGS. 8 and 10. FIG. 10 shows a partial diagram of an embedded antenna according to a seventh embodiment. In the seventh embodiment, the embedded antenna 21 is exemplified by an embedded antenna 21*g*. The embedded antenna 21*g* is different the embedded antenna 21*f* mainly in that the sleeve part 217*b* is adjacent to the radiating part 212*a*, and the sleeve part 217*a* is extended outwards from the sleeve part 217*b* along a direction opposite to the extending direction of the radiating part 212*a*. The embedded antenna 21*g* may change the magnitude of bandwidth through the adjustment in the magnitude of the diameter g2.

Eighth Embodiment

Figure 34:
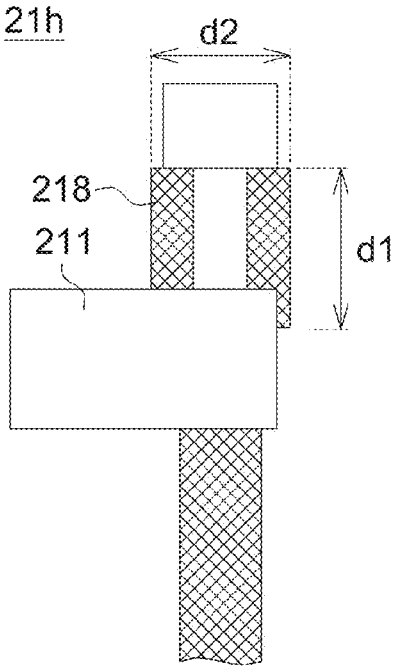
FIG. 34 shows a front view of an embedded antenna according to an eighth embodiment.
Figure 35:
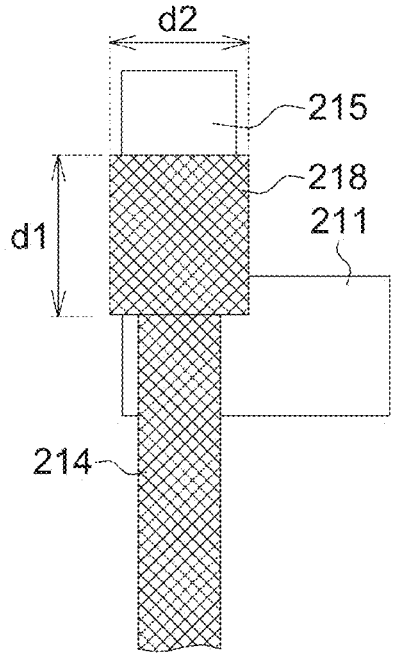
FIG. 35 shows a rear view of an embedded antenna according to an eighth embodiment.
Figure 36:
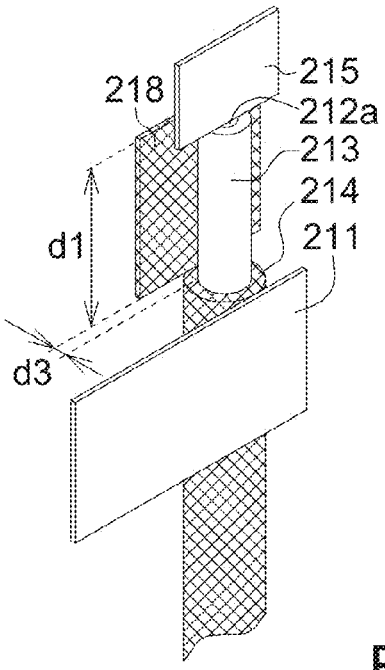
FIG. 36 shows a side view of an embedded antenna according to an eighth embodiment.

Referring to FIG. 2, FIG. 34, FIG. 35 and FIG. 36. FIG. 34 shows a front view of an embedded antenna according to an eighth embodiment. FIG. 35 shows a rear view of an embedded antenna according to an eighth embodiment. FIG. 36 shows a side view of an embedded antenna according to an eighth embodiment. In the eighth embodiment, the embedded antenna 21 is exemplified by an embedded antenna 21*h*. The embedded antenna 21*h* is different the embedded antenna 21*d* mainly in that the embedded antenna 21*h* further comprises a extension sheath 218. The extension sheath 218, being extended as a plane, is electrically connected to the outer sheath 214. The outer sheath 214 and the grounding connecting part 211 are, for example, disposed on two sides of the insulating layer 213. The area of the extension sheath 218 is the product of length d1 multiplied by width d2, and the extension sheath 218 is separated from the insulating layer by a distance d3. The embedded antenna 21*h* may adjust the antenna bandwidth through suitable adjustment in the length d1, the width d2 and the distance d3. Apart from that, the extension sheath 218, realized by such as a copper foil, an aluminum foil or a conductive cloth, still can achieve similar effects. In one alternate embodiment, the outer sheath 214 and the grounding connecting part 211 may be disposed on the same side of the insulating layer 213.

Figure 1:
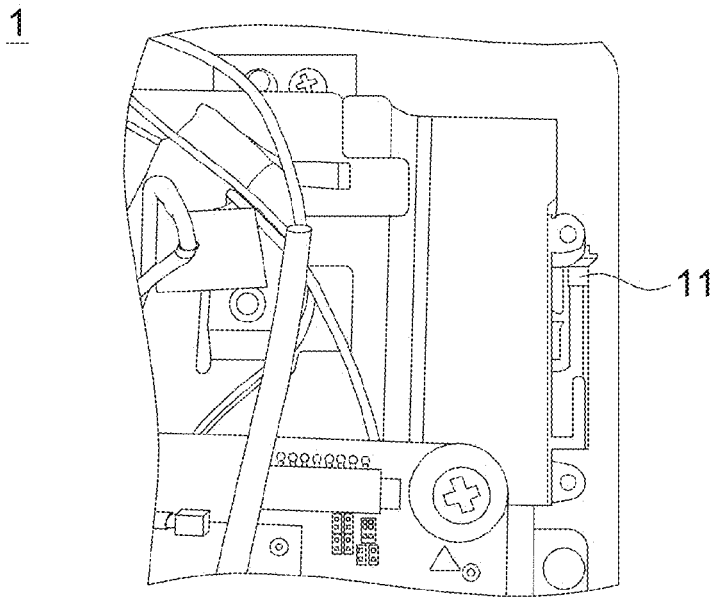
FIG. 1(Prior Art)
FIG. 1 shows a schematic diagram of an AIO using a conventional inverted-F antenna.
Figure 11:
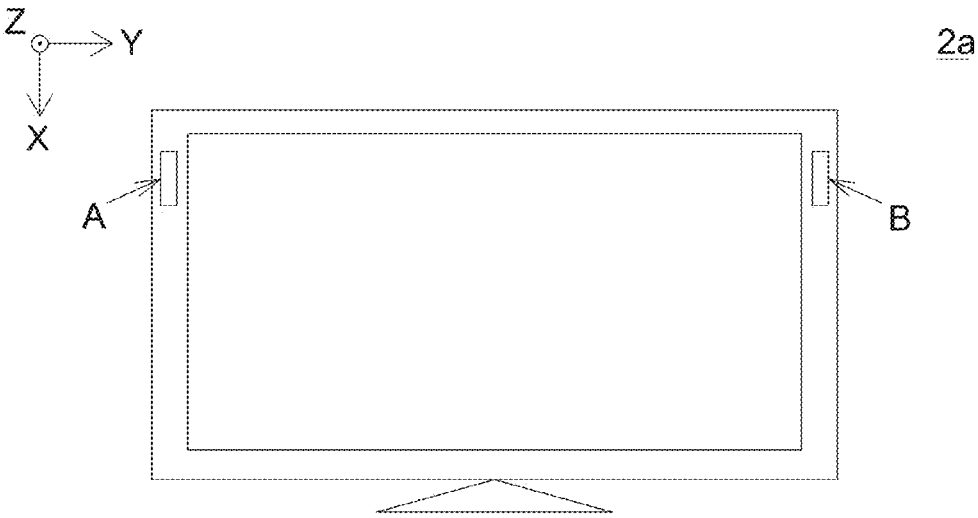
FIG. 11 shows a schematic diagram of disposing embedded antennas at positions A and B of an AIO.
Figure 12:
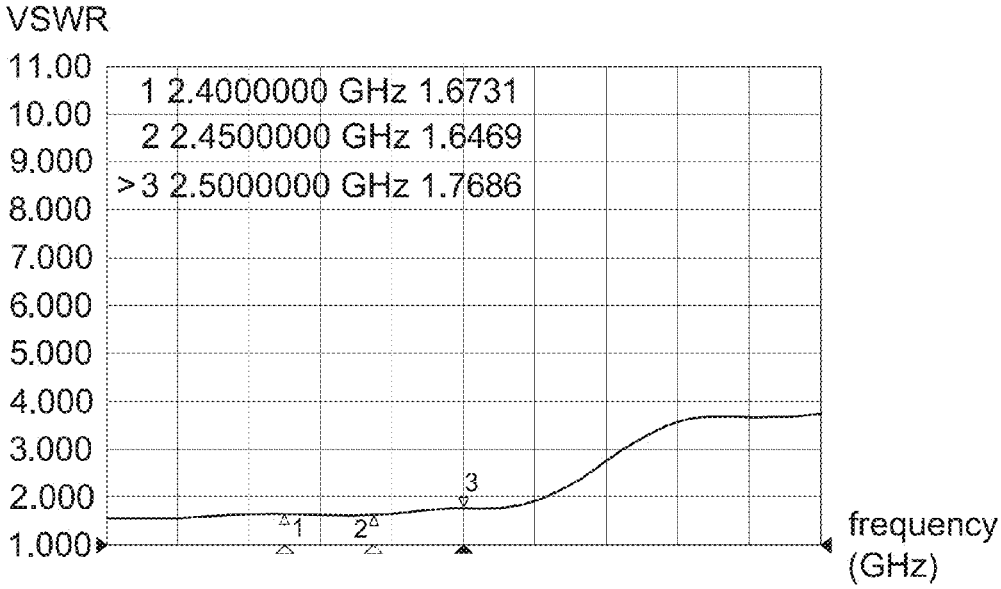
FIG. 12 shows a VSWR chart of a master antenna.
Figure 13:
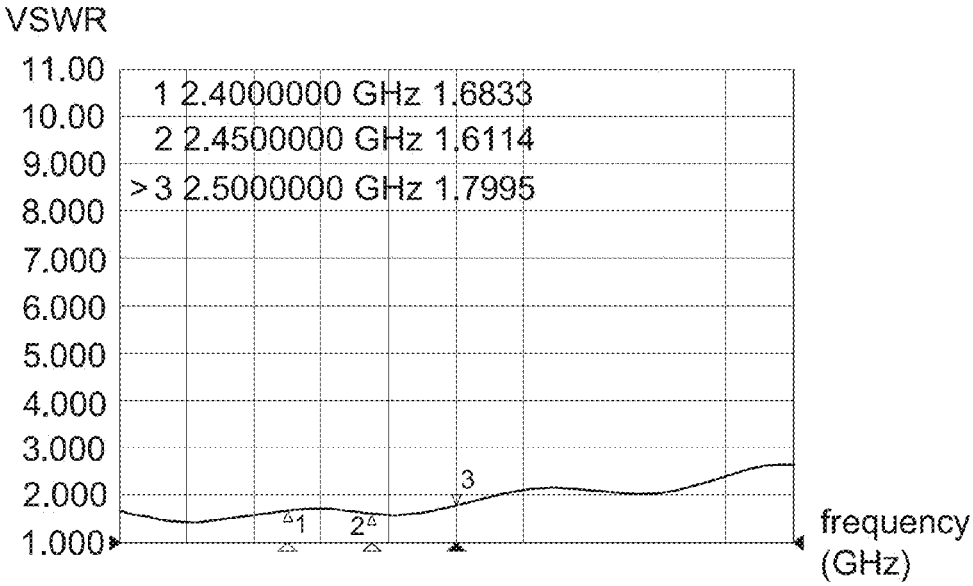
FIG. 13 shows a VSWR chart of a slave antenna.

Referring to FIG. 11, FIG. 12 and FIG. 13. FIG. 11 shows a schematic diagram of disposing embedded antennas at positions A and B of an AIO. FIG. 12 shows a VSWR chart of a master antenna. FIG. 13 shows a VSWR chart of a slave antenna. For convenience of elaboration, the electronic device 2 is exemplified by an 18.5 inch AIO 2*a* in FIG. 11, and the coordinate axis Z is ejected in a direction perpendicular to the plane of the paper. The embedded antenna 21*a* may be disposed at position A of the rim of the AIO 2*a* and used as a master antenna. The other embedded antenna 21*a* may be disposed at position B of the rim of the AIO 2*a* and used as a slave antenna. In the industry, the standard value for the antenna VSWR is normally set as 2. As shown in FIG. 1, the VSWR values for the master antenna at frequencies 2.4 GHz, 2.45 GHz and 2.5 GHz are equal to 1.6731, 1.6469, and 1.7686 respectively. As shown in FIG. 13, the VSWR values for the slave antenna at frequencies 2.4 GHz, 2.45 GHz and 2.5 GHz are equal to 1.6833, 1.6114, and 1.7995 respectively. When the embedded antenna 21*a* is used in a wireless local area network (WLAN), regardless being a master antenna or a slave antenna, the VSWR values corresponding to the frequency range of 2.4 GH~2.5 GHz are all conformed to the standard values of the industry.

Figure 14:
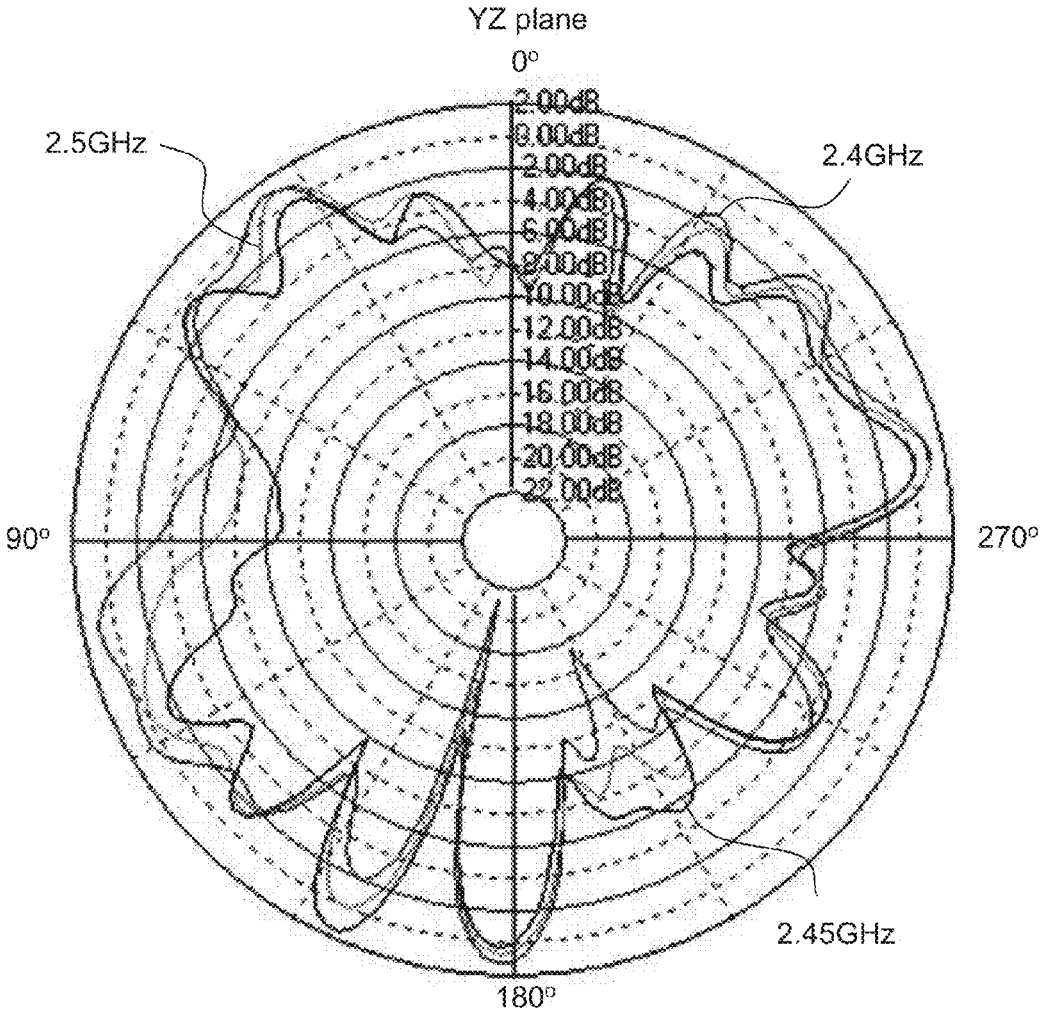
FIG. 14 shows a field pattern of a master antenna on YZ-plane.
Figure 15:
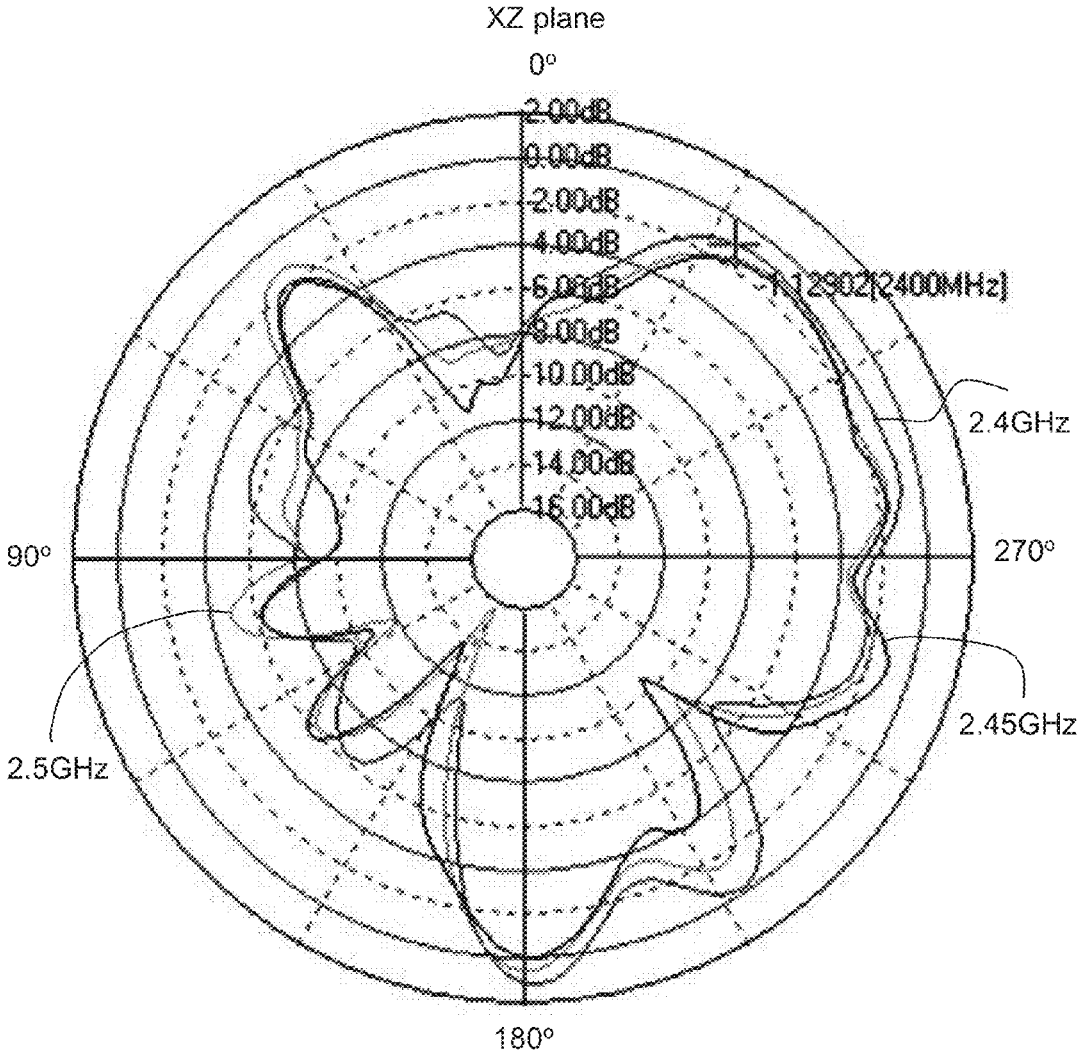
FIG. 15 shows a field pattern of a master antenna on XZ-plane.
Figure 16:
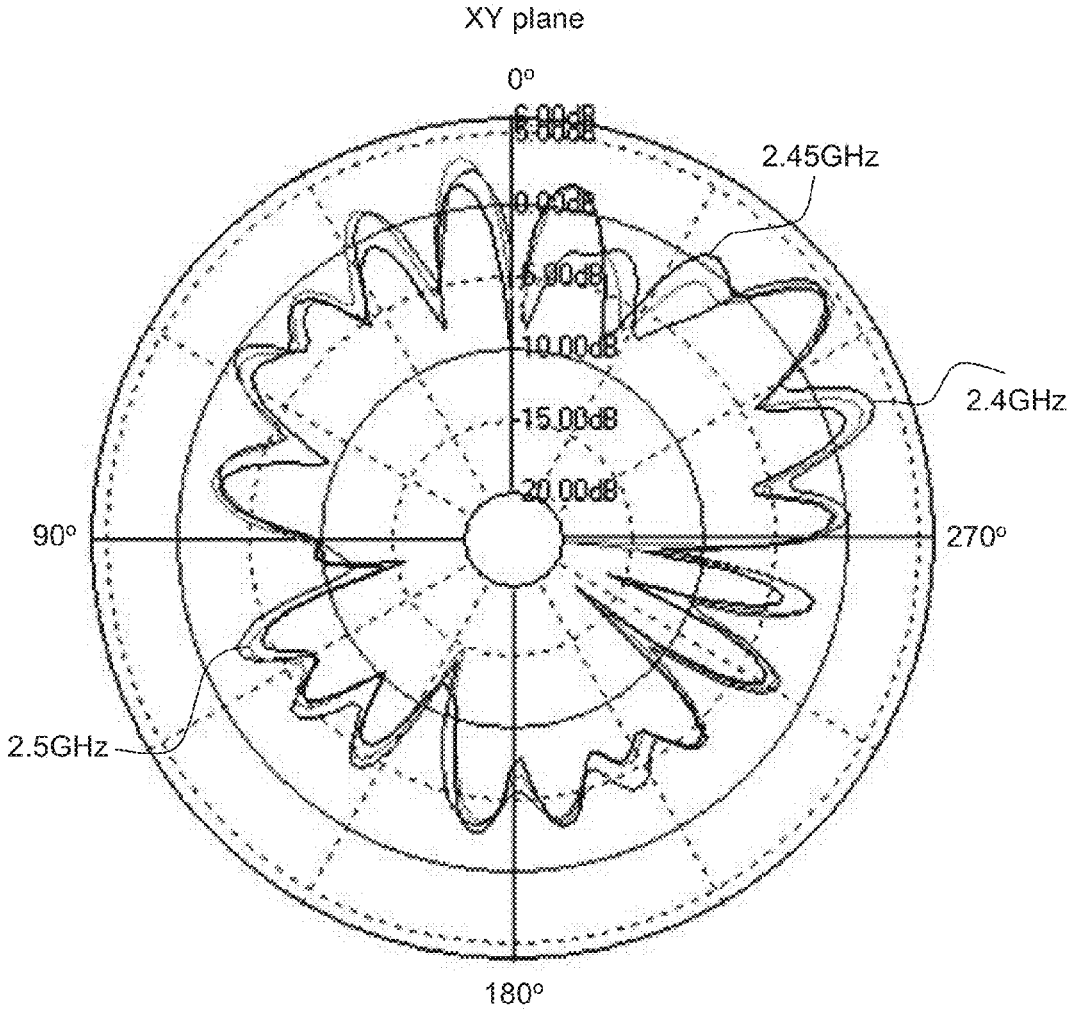
FIG. 16 shows a field pattern of a master antenna on XY-plane.
Figure 17:
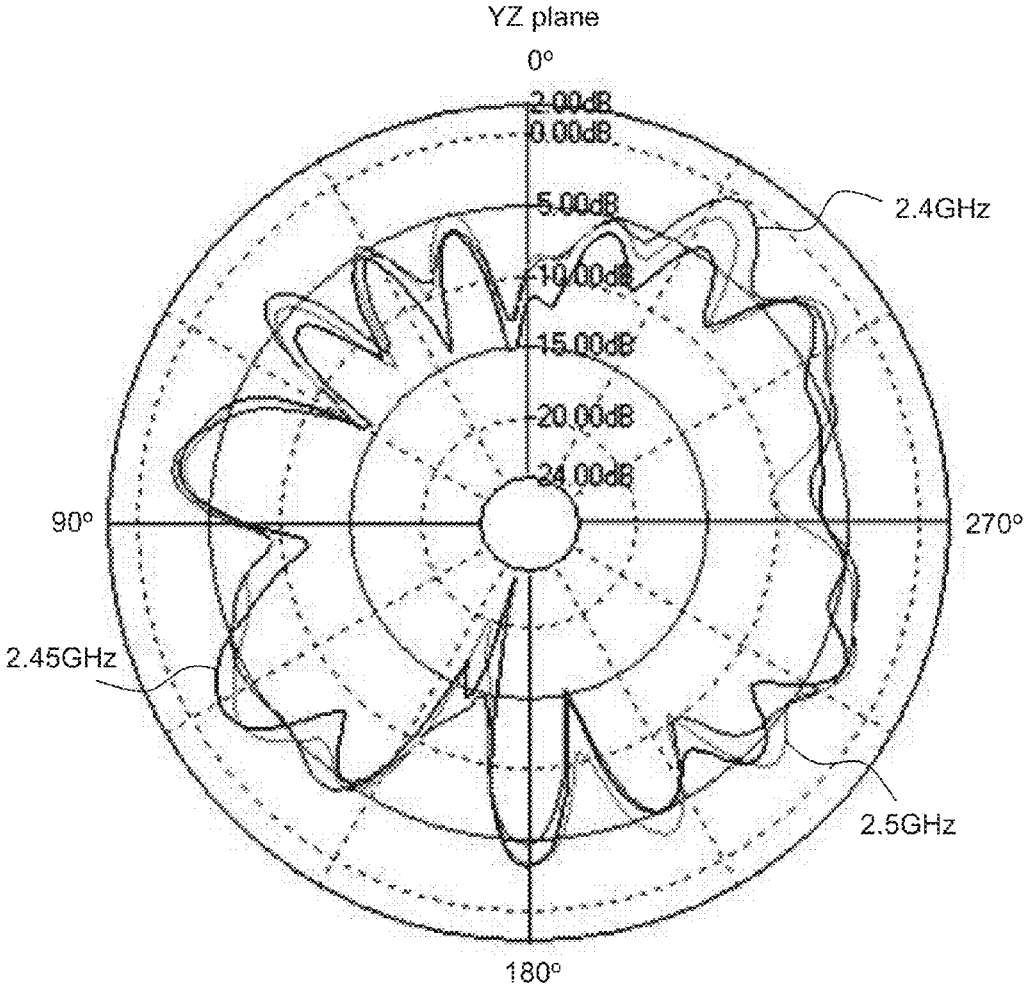
FIG. 17 shows a field pattern of a slave antenna on YZ-plane.
Figure 18:
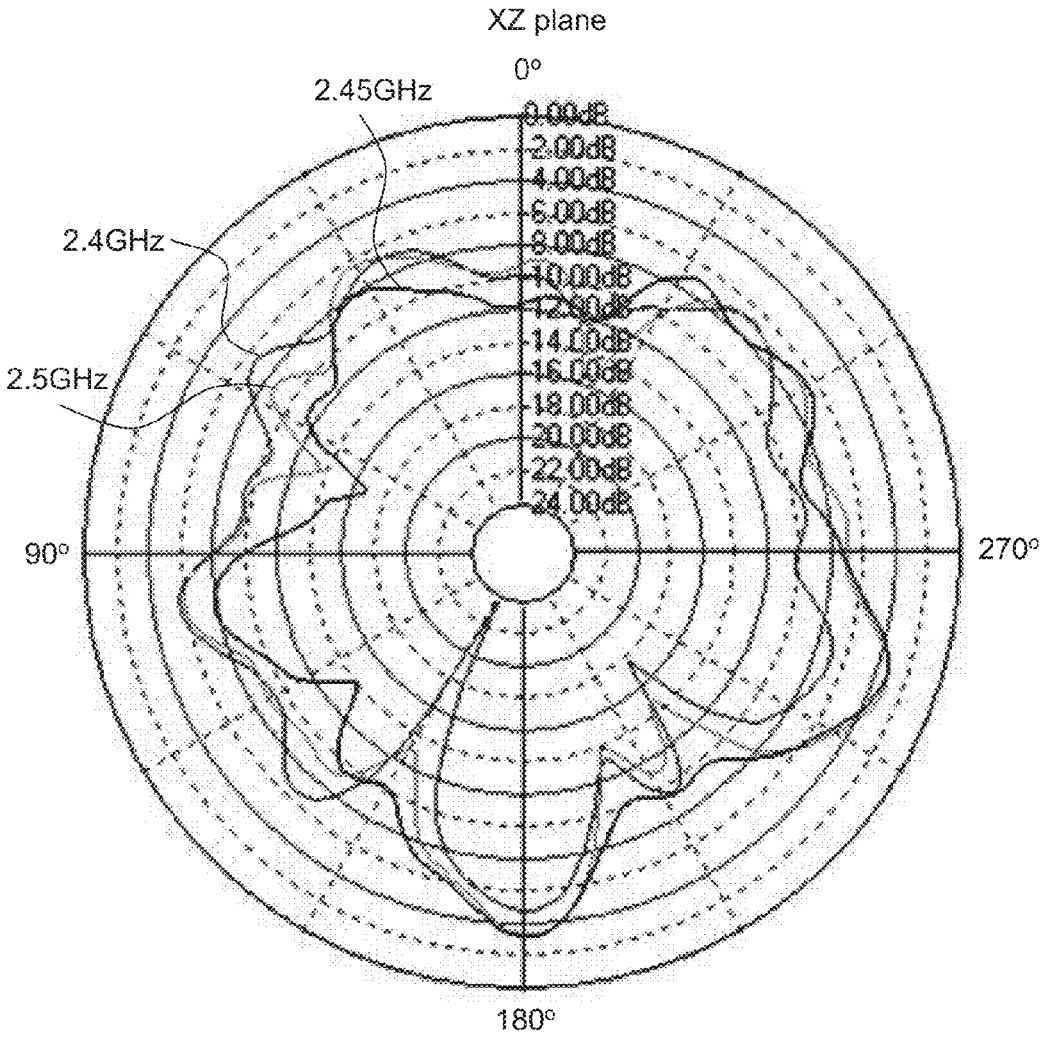
FIG. 18 shows a field pattern of a slave antenna on XZ-plane.
Figure 19:
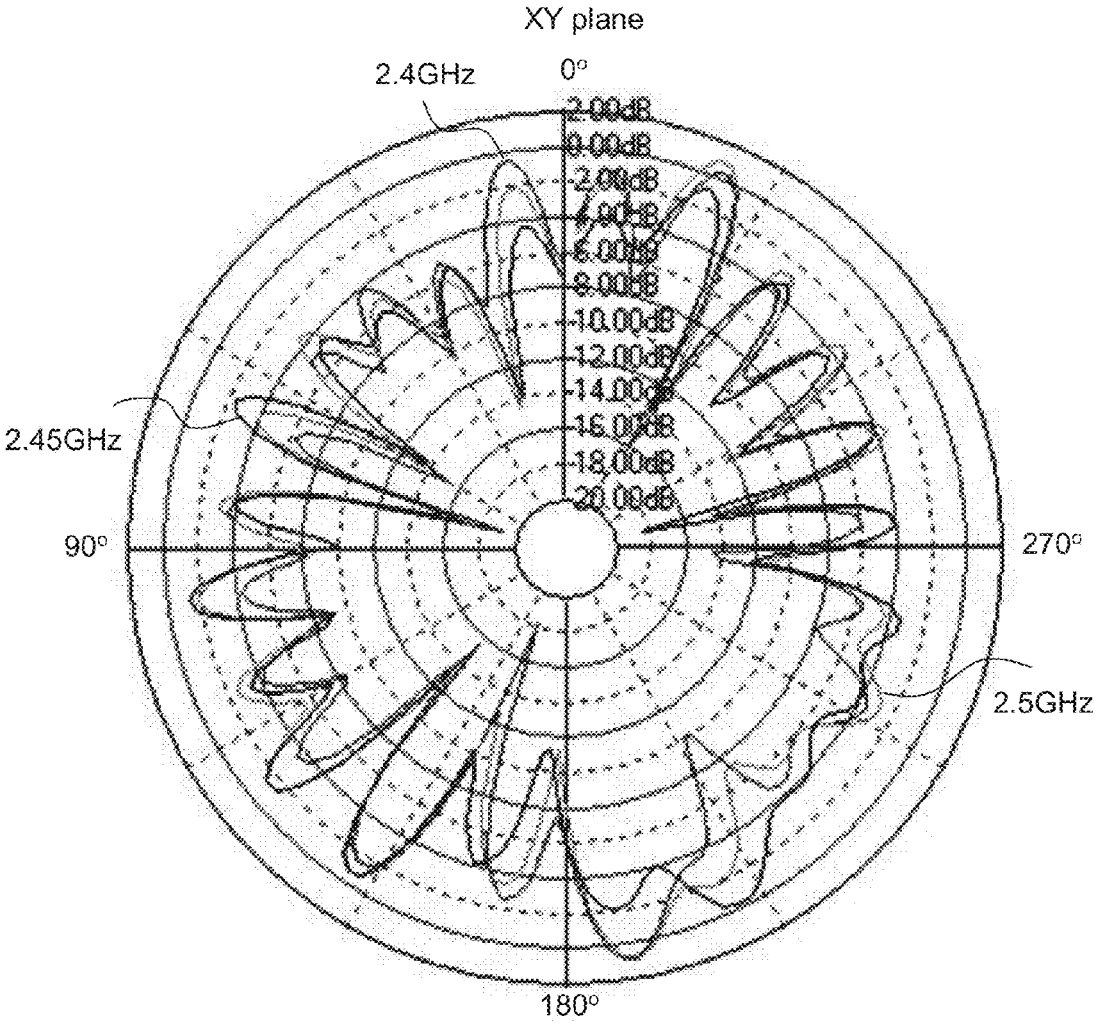
FIG. 19 shows a field pattern of a slave antenna on XY-plane.

Referring to FIG. 11, FIG. 14, FIG. 15, FIG. 16, FIG. 17, FIG. 18 and FIG. 19. FIG. 14 shows a field pattern of a master antenna on YZ-plane. FIG. 15 shows a field pattern of a master antenna on XZ-plane. FIG. 16 shows a field pattern of a master antenna on XY-plane. FIG. 17 shows a field pattern of a slave antenna on YZ-plane. FIG. 18 shows a field pattern of a slave antenna on XZ-plane. FIG. 19 shows a field pattern of a slave antenna on XY-plane. FIG. 14, FIG. 15 and FIG. 16 show the antenna field patterns for a master antenna on YZ-plane, XZ-plane and XY-plane respectively. FIG. 17, FIG. 18 and FIG. 19 show the antenna field patterns for a slave antenna on YZ-plane, XZ-plane and XY-plane respectively. The achieved efficiency is over 40% for both the master antenna and the slave antenna.

Figure 20:
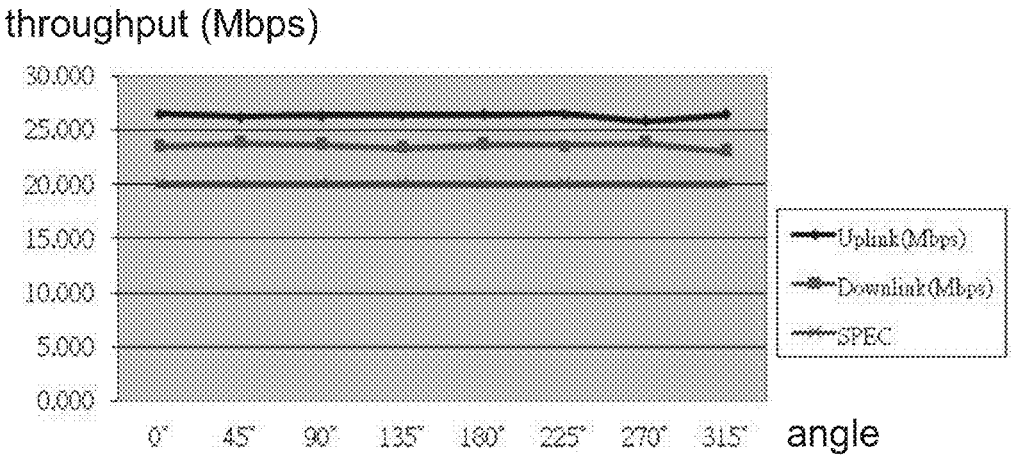
FIG. 20 shows a throughput chart obtained by testing 802.11g at different angles with a wireless network card.
Figure 21:
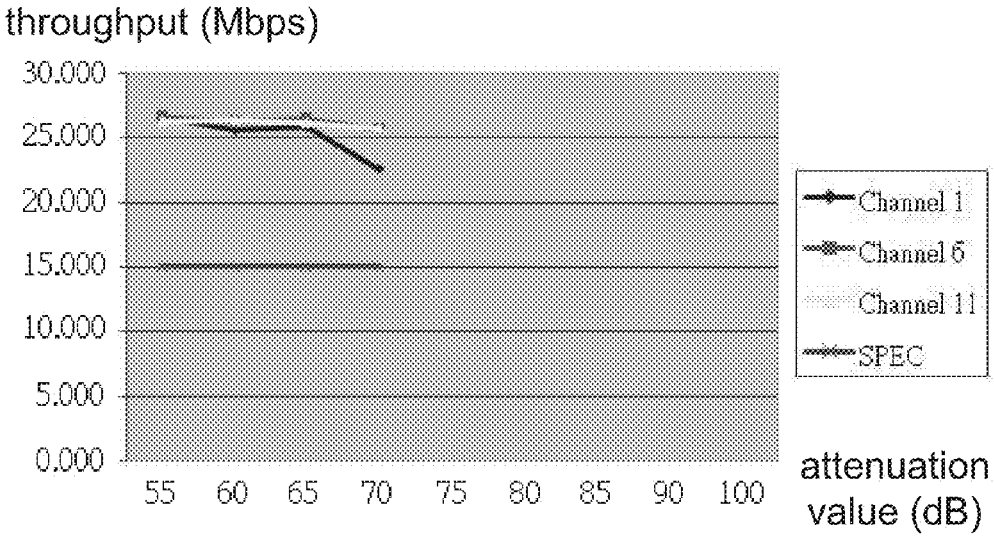
FIG. 21 shows an uplink throughput chart for different channels of 802.11n.
Figure 22:
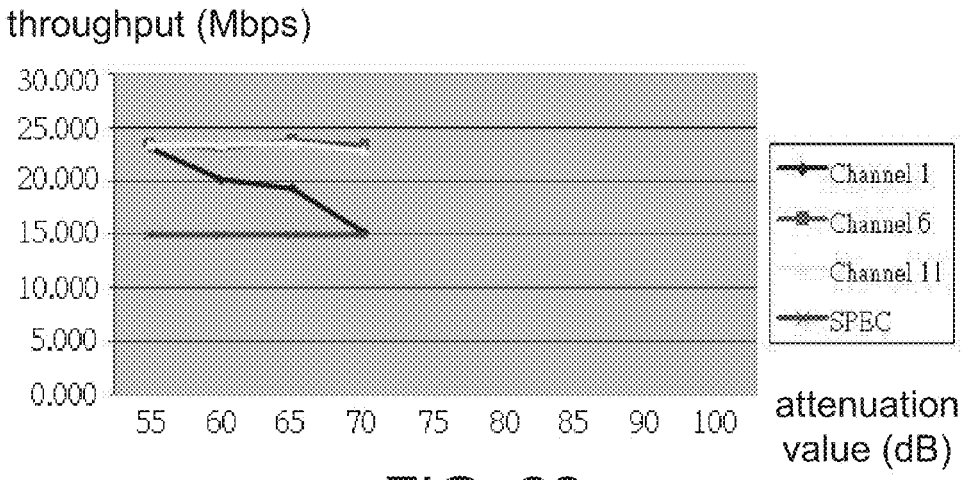
FIG. 22 shows an downlink throughput chart for different channels of 802.11n.
Figure 23:
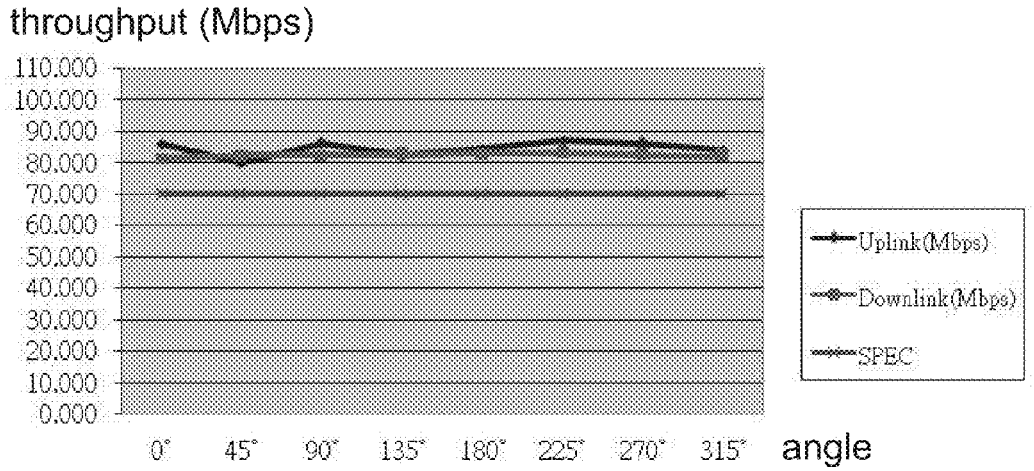
FIG. 23 shows a throughput chart obtained by testing 802.11g at different angles with a wireless network card.
Figure 24:
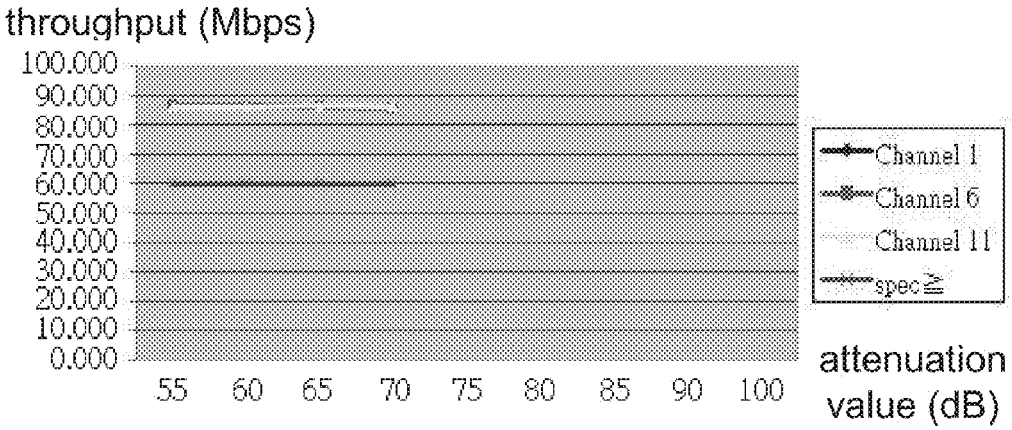
FIG. 24 shows an uplink throughput chart for different channels of 802.11g.
Figure 25:
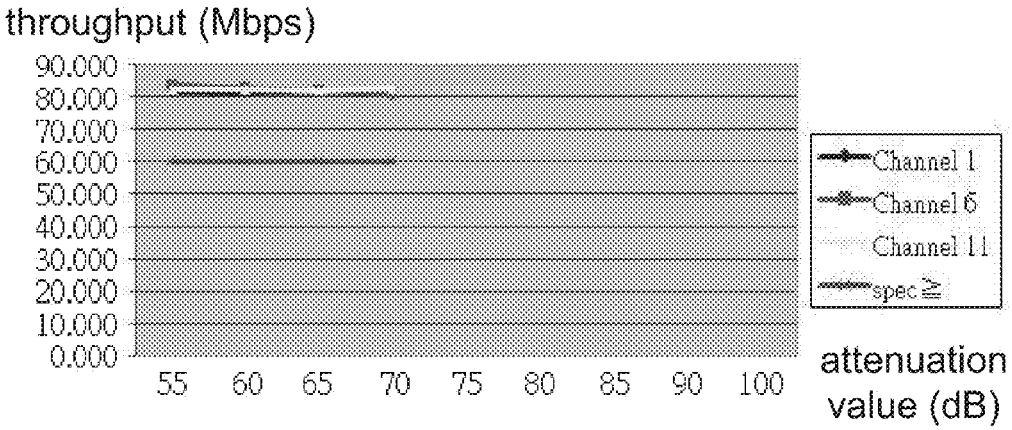
FIG. 25 shows a downlink throughput chart for different channels of 802.11g.

Referring to FIG. 20, FIG. 21, FIG. 22, FIG. 23, FIG. 24 and FIG. 25. FIG. 20 shows a throughput chart obtained by testing 802.11g at different angles with a wireless network card. FIG. 21 shows an uplink throughput chart for different channels of 802.11n. FIG. 22 shows a downlink throughput chart for different channels of 802.11n. FIG. 23 shows a throughput chart obtained by testing 802.11g at different angles with a wireless network card. FIG. 24 shows an uplink throughput chart for different channels of 802.11g. FIG. 25 shows a downlink throughput chart for different channels of 802.11g.

A comparison of performance for the embedded antenna under two transmission protocols (namely, 802.11g and 802.11n) is made by using a wireless network card WPET-123GN. Firstly, radio channel 2412 MHz is used for determining the angle corresponding to the worst throughput for an AIO. Next, a comparison of performance under different signal attenuations and different radio channels is made. The testing environment is that both the object and the embedded antenna are disposed at an anechoic chamber, and the total path loss at the anechoic chamber is 55 dB. As shown in FIG. 20, when the total path loss is 55 dB, the angle corresponding to the worst throughput obtained by the aforementioned embedded antenna under 802.11g is 315°. FIG. 21 and FIG. 22 respectively show the uplink throughput and the downlink throughput corresponding to different attenuation values and channels under 802.11g at an angle of 315°.

Similarly, as shown in FIG. 23, when the total path loss is 55 dB, the angle corresponding to the worst throughput obtained by the aforementioned embedded antenna under 802.11n is 0°. FIG. 24 and FIG. 25 respectively show the uplink and the downlink throughput corresponding to different attenuation values and respective channels under 802.11n at an angle of 0°.

Figure 26:
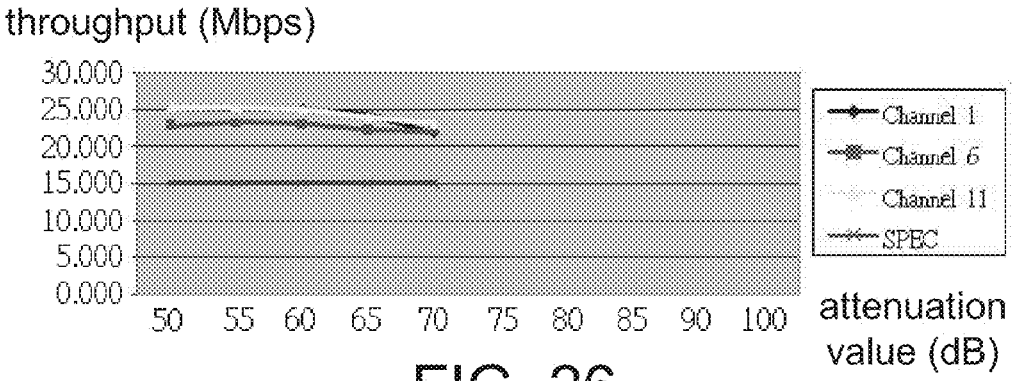
FIG. 26 shows an uplink throughput diagram of an AIO using a conventional inverted-F antenna under 802.11g.
Figure 27:
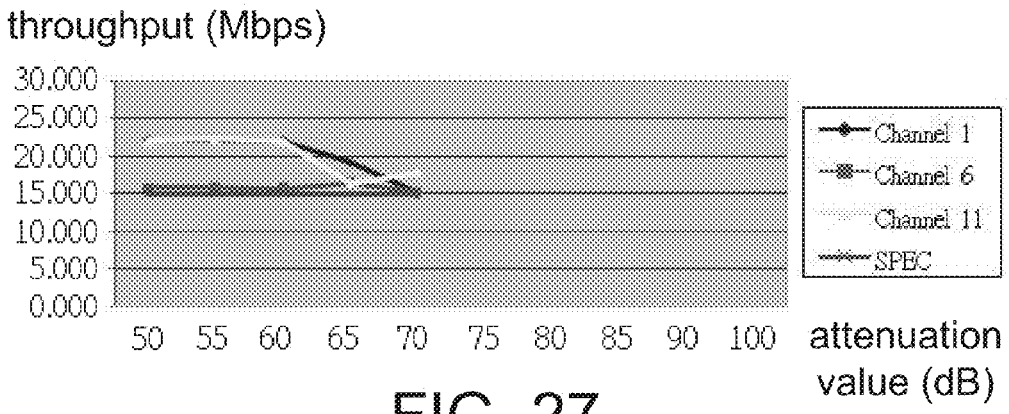
FIG. 27 shows a downlink throughput diagram of an AIO using a conventional inverted-F antenna under 802.11g.
Figure 28:
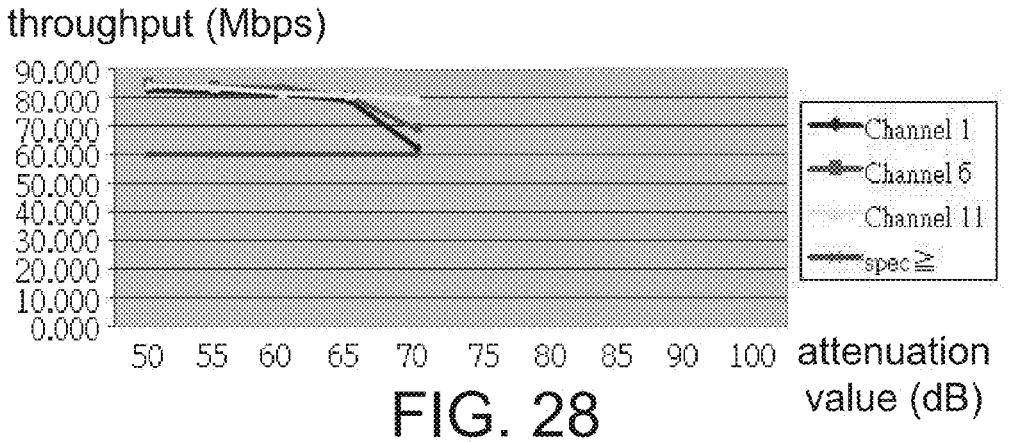
FIG. 28 shows an uplink throughput diagram of an AIO using a conventional inverted-F antenna under 802.11n.
Figure 29:
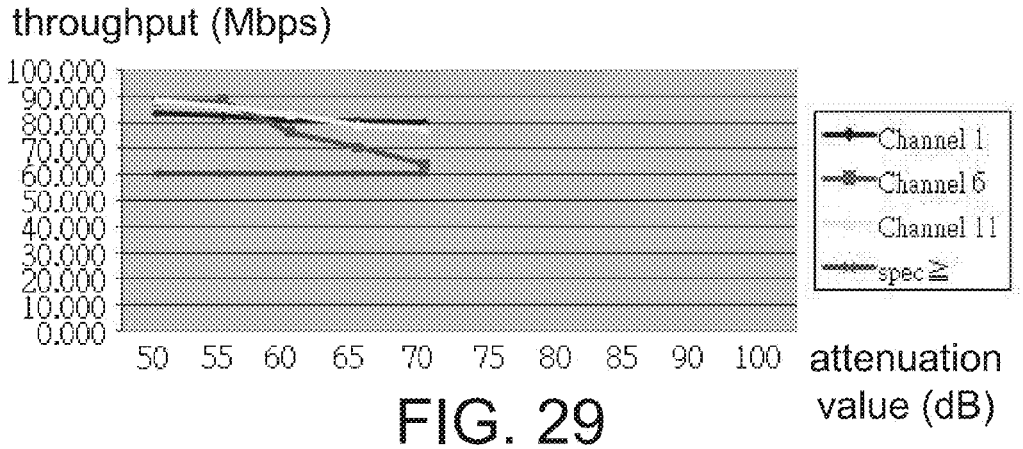
FIG. 29 shows a downlink throughput diagram of an AIO using a conventional inverted-F antenna under 802.11n.

Referring to FIG. 26, FIG. 27, FIG. 28 and FIG. 29. FIG. 26 shows an uplink throughput diagram of an AIO using a conventional inverted-F antenna under 802.11g. FIG. 27 shows a downlink throughput diagram of an AIO using a conventional inverted-F antenna under 802.11g. FIG. 28 shows an uplink throughput diagram of an AIO using a conventional inverted-F antenna under 802.11n. FIG. 29 shows a downlink throughput diagram of an AIO using a conventional inverted-F antenna under 802.11n. A comparison of performance between the AIO using a conventional inverted-F antenna and the AIO using an embedded antenna disclosed in above embodiments shows that the embedded antenna disclosed in above embodiments still has better performance than the conventional inverted-F antenna even when the signal has severe attenuations.

Figure 30:
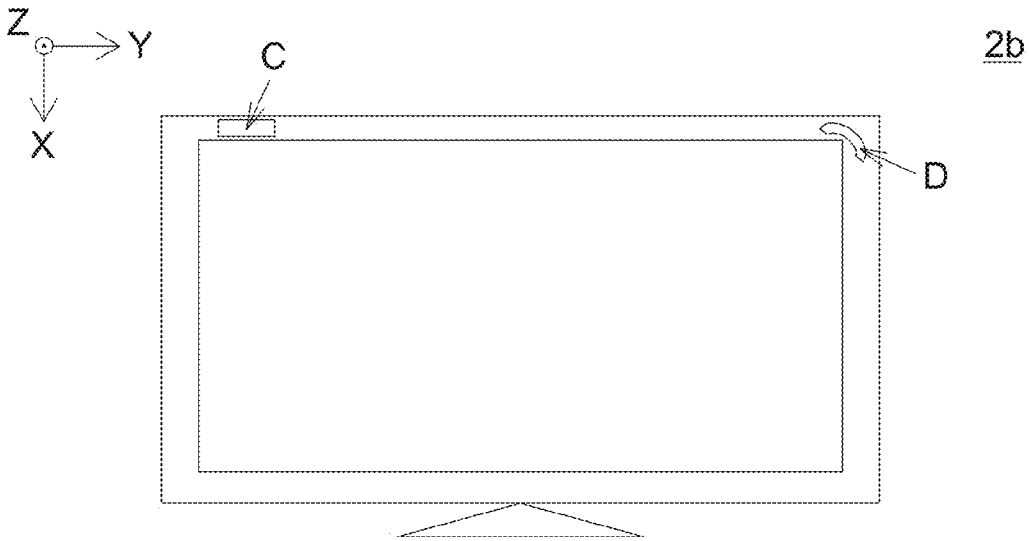
FIG. 30 shows a schematic diagram of disposing embedded antennas at positions C and D of an AIO.

Referring to FIG. 30 and Table 1. FIG. 30 shows a schematic diagram of disposing embedded antennas at positions C and D of an AIO. For convenience of elaboration, the electronic device 2 is exemplified by an 18.5 inch AIO 2*b* in FIG. 11, and the coordinate axis Z is ejected in a direction perpendicular to the plane of the paper.

The embedded antenna 21*a* has lower dependency on mechanism environment, and the embedded antenna 21*a* is more flexible than the conventional inverted-F antenna in terms of disposition position. For example, the aforementioned embedded antenna 21*a* may be disposed at position C on the rim of the AIO 2*b* and used as a master antenna, while the other embedded antenna 21*a* may be curved to be disposed at position D on the rim of the AIO 2*b* and used as a slave antenna. As shown in Table 1, the performance of radiation efficiency is above 40% for both the master antenna and the slave antenna.

TABLE 1

| Frequency (GHz) | Position C 3D Efficiency (%) | Position D 3D Efficiency (%) |
|---|---|---|
| 2.4 | 43.34 | 52.75 |
| 2.45 | 43.99 | 53.95 |
| 2.5 | 44.78 | 51.07 |

Figure 31:
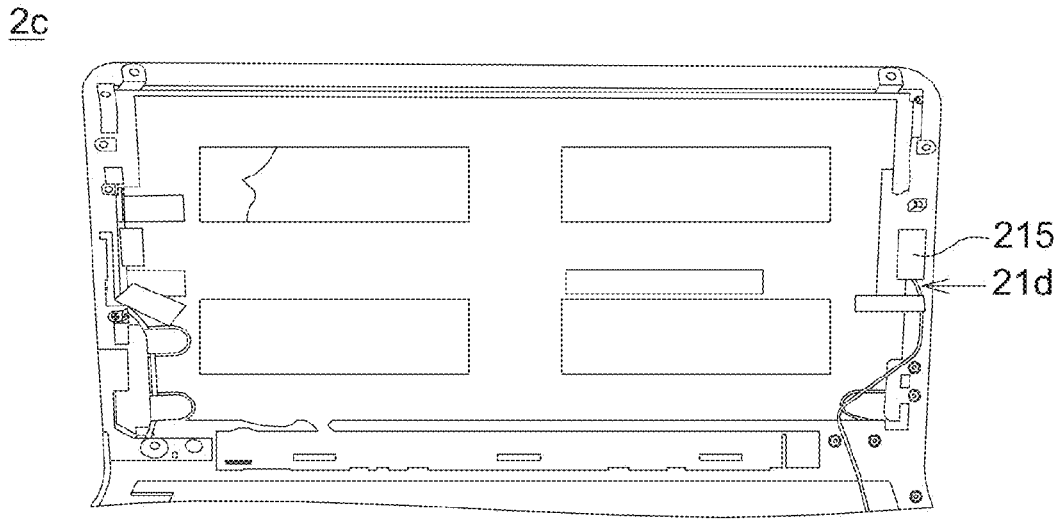
FIG. 31 shows a schematic diagram of a notebook computer.
Figure 32:
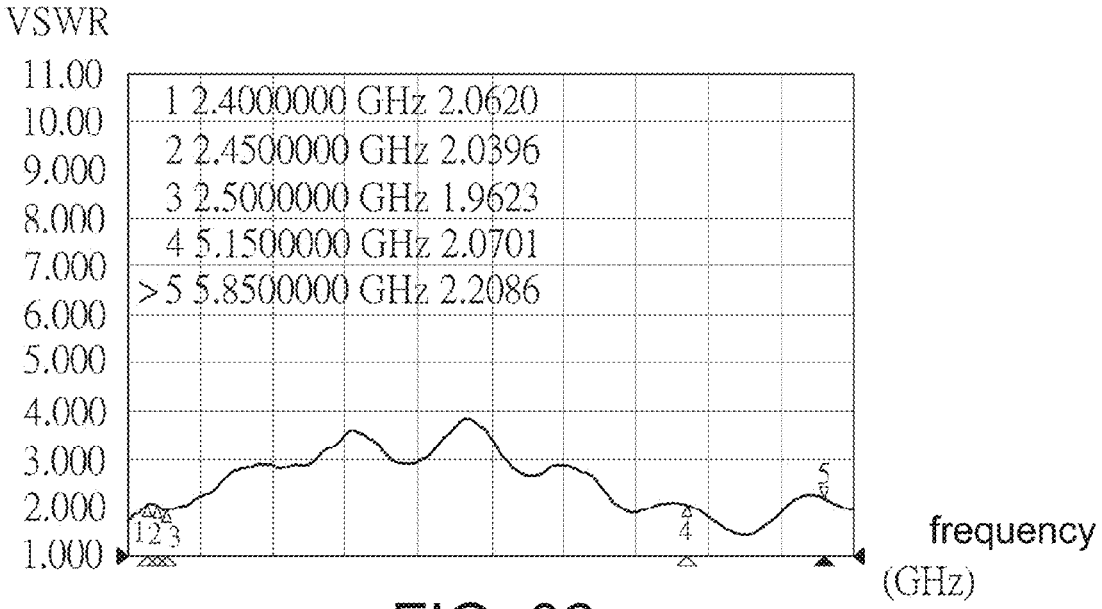
FIG. 32 shows a schematic diagram of a VSWR chart of FIG. 31.
Figure 33:
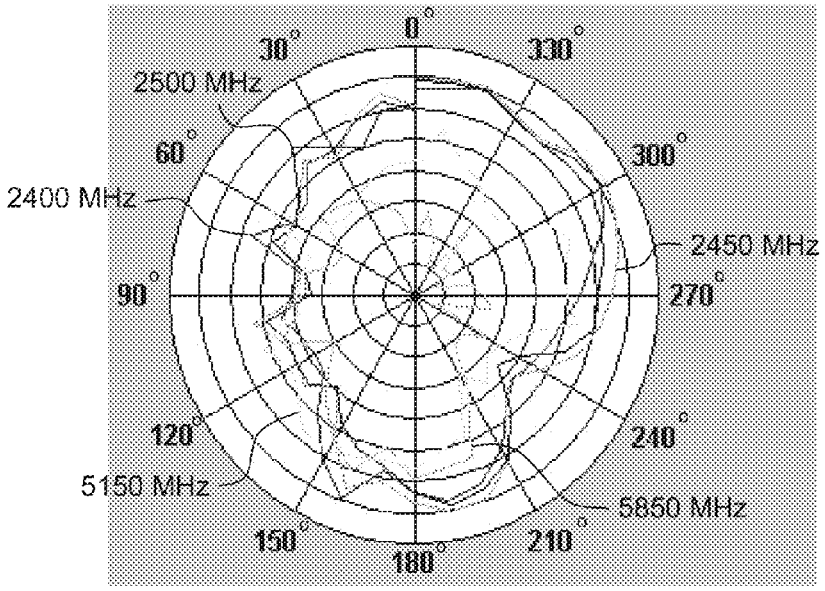
FIG. 33 shows an antenna field pattern of FIG. 31.

Referring to FIG. 31, FIG. 32, FIG. 33 and Table 2. FIG. 31 shows a schematic diagram of a notebook computer. FIG. 32 shows a schematic diagram of a VSWR chart of FIG. 31. FIG. 33 shows an antenna field pattern of FIG. 31. For convenience of elaboration, the electronic device 2 is exemplified by a 10.1 inch notebook computer 2*c* in FIG. 31, and the coordinate axis Z is ejected in a direction perpendicular to the plane of the paper. As shown in FIG. 32, the VSWR values for the embedded antenna 215 are respectively 2.0620, 2.0396, 1.9623, 2.0701 and 2.2086 under the frequencies of 2.4 GHz, 2.45 GHz, 2.5 GHz, 5.15 GHz and 5.85 GHz. Table 2 shows that the efficiency performance for the embedded antenna 215 is larger than 50%. FIG. 33 also shows that the embedded antenna 215 has superior antenna field pattern.

TABLE 2

| Frequency (GHz) | 3D Efficiency (%) |
|---|---|
| 2.4 | 53.14 |
| 2.45 | 61.94 |
| 2.5 | 58.69 |
| 5.15 | 51.47 |
| 5.85 | 53.02 |

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. An embedded antenna, comprising:

a coaxial cable, comprising:

a center conductor, comprising:

a signal transmission part; and a first radiating part electrically connecting the signal transmission part and providing a first resonance frequency;

an insulating layer for covering the signal transmission part and the first radiating part; and an outer sheath for covering the signal transmission part but not the first radiating part;

a grounding connecting part for electrically connecting a system grounding part and the outer sheath; and an extension sheath extended with a planar shape in a plane and electrically connected to the outer sheath.

2. The embedded antenna according to claim 1, wherein the grounding connecting part is realized by a copper foil tape.

3. The embedded antenna according to claim 1, wherein the length of the first radiating part corresponds to a quarter of the wavelength of the first resonance frequency.

4. The embedded antenna according to claim 1, wherein the first radiating part is L-shaped.

5. The embedded antenna according to claim 1, wherein the center conductor further comprises:

a second radiating part electrically and physically connected to an end of the first radiating part and providing a second resonance frequency different from the first resonance frequency.

6. The embedded antenna according to claim 5, wherein the second radiating part is extended with planar shape in another plane.

7. The embedded antenna according to claim 6, wherein the planar shape of the second radiating part is rectangular.

8. The embedded antenna according to claim 5, wherein the total length of the first radiating part and the second radiating part corresponds to a quarter of the wavelength of the first resonance frequency.

9. The embedded antenna according to claim 1, further comprising:

a second radiating part electrically connected to the first radiating part and providing a second resonance frequency different from the first resonance frequency.

10. The embedded antenna according to claim 9, wherein the second radiating part is realized by a copper foil tape.

11. The embedded antenna according to claim 9, wherein the total length of the first radiating part and the second radiating part corresponds to a quarter of the wavelength of the first resonance frequency.

12. The embedded antenna according to claim 1, further comprising:

a metal sleeve covering at least a part of the outer sheath.

13. The embedded antenna according to claim 1, further comprising:

a metal sleeve for covering at least a part of the insulating layer.

14. The embedded antenna according to claim 13, wherein the metal sleeve comprises:

a first sleeve part having a first diameter; and a second sleeve part connected to the first sleeve part and having a second diameter larger than the first diameter.

* * * * *